US005774040A

United States Patent [19]

Lastoria

[11] Patent Number: 5,774,040

[45] Date of Patent: Jun. 30, 1998

[54] FIRE SOUND SIMULATOR

[76] Inventor: Dominic H. Lastoria, 13652 108th Avenue, Surrey, Canada, V3T 2K5

[21] Appl. No.: 909,188

[22] Filed: Aug. 11, 1997

[51] Int. Cl.[6] ..... G08B 3/10

[52] U.S. Cl. ..... 340/384.3; 340/384.7; 340/691; 40/428; 472/64

[58] Field of Search ..... 340/384.3, 384.7, 340/577, 584, 691; 40/428; 472/64, 65

[56] References Cited

U.S. PATENT DOCUMENTS

| | | | |
|---|---|---|---|
| 3,723,046 | 3/1973 | Poling et al. | 472/64 |
| 5,099,591 | 3/1992 | Eiklor et al. | 472/64 |
| 5,594,802 | 1/1997 | Berghoff et al. | 381/61 |
| 5,635,898 | 6/1997 | Walters et al. | 340/384.7 |

*Primary Examiner*—Jeffery A. Hofsass
*Assistant Examiner*—Daniel J. Wu
*Attorney, Agent, or Firm*—Douglas E. Mackenzie

[57] ABSTRACT

A new Fire Sound Simulator for simulating the hissing, popping and crackling sound of a fire includes a white noise generator for generating a white noise signal representative of a hissing sound, a ROM-based sound generator for generating a popping signal representative of a popping sound, a ROM-based sound generator for generating a crackling signal representative of a crackling sound, a microcontroller operably coupled to the ROM-based sound generator for generating the popping signal and the ROM-based sound generator for generating the crackling signal, the microcontroller generating a first start signal for activating the ROM-based sound generator for generating the popping signal and a second start signal for activating the ROM-based sound generator for generating the crackling signal, a mixer for mixing the white noise signal, the popping signal and the crackling signal, and for generating an amplifier input signal, the mixer being operably coupled to the microcontroller, an audio amplifier for amplifying the amplifier input signal and for generating an amplifier output signal and a sound speaker connected to receive the amplifier output signal.

9 Claims, 2 Drawing Sheets

FIG 2
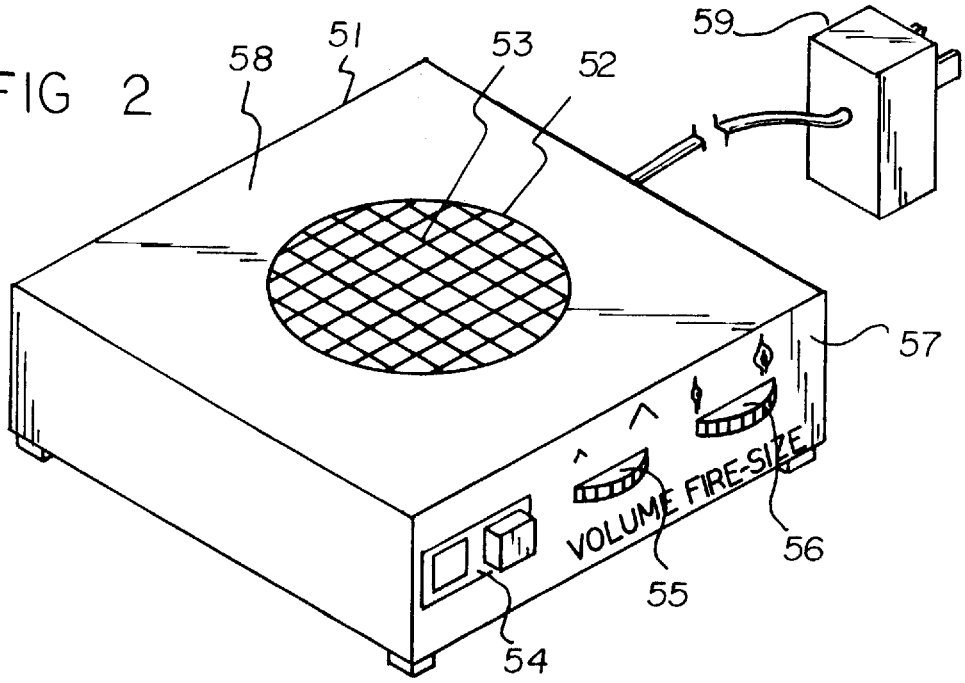
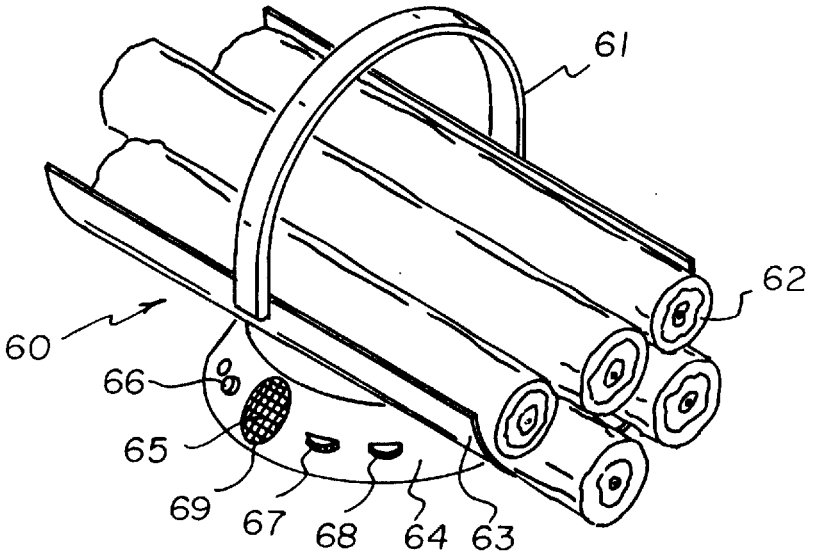
FIG 3

FIRE SOUND SIMULATOR

BACKGROUND OF THE INVENTION

1. Field of the Invention

The present invention relates to sound simulators and more particularly pertains to a new Fire Sound Simulator for simulating the hissing, popping and crackling sound of a fire.

2. Description of the Prior Art

The use of sound simulators is known in the prior art. More specifically, sound simulators heretofore devised and utilized are known to consist basically of familiar, expected and obvious structural configurations, notwithstanding the myriad of designs encompassed by the crowded prior art which have been developed for the fulfillment of countless objectives and requirements.

Known prior art sound simulators include U.S. Pat. Nos. 5,099,591; U.S. Pat. No. 4,026,544; U.S. Pat. No. 3,978,598; U.S. Pat. No. 5,237,903; and U.S. Pat. No. 3,913,097.

While these devices fulfill their respective, particular objectives and requirements, the aforementioned patents do not disclose a new Fire Sound Simulator. The inventive device includes a white noise generator for generating a white noise signal representative of a hissing sound, a means for generating a popping signal representative of a popping sound, a means for generating a crackling signal representative of a crackling sound, a microcontroller operably coupled to the means for generating the popping signal and the means for generating the crackling signal, the microcontroller generating a first start signal for activating the means for generating the popping signal and a second start signal for activating the means for generating the crackling signal, a mixing means for mixing the white noise signal, the popping signal and the crackling signal, and for generating an amplifier input signal, the mixing means being operably coupled to the microcontroller, an audio amplifier for amplifying the amplifier input signal and for generating an amplifier output signal and a sound speaker connected to receive the amplifier output signal.

In these respects, the Fire Sound Simulator according to the present invention substantially departs from the conventional concepts and designs of the prior art, and in so doing provides an apparatus primarily developed for the purpose of simulating the hissing, popping and crackling sound of a fire.

SUMMARY OF THE INVENTION

In view of the foregoing disadvantages inherent in the known types of sound simulators now present in the prior art, the present invention provides a new Fire Sound Simulator construction wherein the same can be utilized for simulating the hissing, popping and crackling sound of a fire.

The general purpose of the present invention, which will be described subsequently in greater detail, is to provide a new Fire Sound Simulator apparatus and method which has many of the advantages of the sound simulators mentioned heretofore and many novel features that result in a new Fire Sound Simulator which is not anticipated, rendered obvious, suggested, or even implied by any of the prior art sound simulators, either alone or in any combination thereof.

To attain this, the present invention generally comprises a white noise generator for generating a white noise signal representative of a hissing sound, a means for generating a popping signal representative of a popping sound, a means for generating a crackling signal representative of a crackling sound, a microcontroller operably coupled to the means for generating the popping signal and the means for generating the crackling signal, the microcontroller generating a first start signal for activating the means for generating the popping signal and a second start signal for activating the means for generating the crackling signal, a mixing means for mixing the white noise signal, the popping signal and the crackling signal, and for generating an amplifier input signal, the mixing means being operably coupled to the microcontroller, an audio amplifier for amplifying the amplifier input signal and for generating an amplifier output signal and a sound speaker connected to receive the amplifier output signal.

In these respects, the Fire Sound Simulator according to the present invention substantially departs from the conventional concepts and designs of the prior art, and in so doing provides an apparatus primarily developed for the purpose of simulating the hissing, popping and crackling sound of a fire.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Fire Sound Simulator apparatus and method which has many of the advantages of the sound simulators mentioned heretofore and many novel features that result in a new Fire Sound Simulator which is not anticipated, rendered obvious, suggested, or even implied by any of the prior art sound simulators, either alone or in any combination thereof.

It is another object of the present invention to provide a new Fire Sound Simulator which may be easily and efficiently manufactured and marketed.

It is a further object of the present invention to provide a new Fire Sound Simulator which is of a durable and reliable construction.

An even further object of the present invention is to provide a new Fire Sound Simulator which is susceptible of a low cost of manufacture with regard to both materials and labor, and which accordingly is then susceptible of low prices of sale to the consuming public, thereby making such Fire Sound Simulator economically available to the buying public.

Still yet another object of the present invention is to provide a new Fire Sound Simulator which provides in the apparatuses and methods of the prior art some of the advantages thereof, while simultaneously overcoming some of the disadvantages normally associated therewith.

Still another object of the present invention is to provide a new Fire Sound Simulator for simulating the hissing, popping and crackling sound of a fire.

Yet another object of the present invention is to provide a new Fire Sound Simulator which includes a white noise generator for generating a white noise signal representative of a hissing sound, a means for generating a popping signal representative of a popping sound, a means for generating a crackling signal representative of a crackling sound, a microcontroller operably coupled to the means for generating the popping signal and the means for generating the crackling signal, the microcontroller generating a first start signal for activating the means for generating the popping signal and a second start signal for activating the means for generating the crackling signal, a mixing means for mixing the white noise signal, the popping signal and the crackling signal, and for generating an amplifier input signal, the mixing means being operably coupled to the microcontroller, an audio amplifier for amplifying the amplifier input signal and for generating an amplifier output signal and a sound speaker connected to receive the amplifier output signal.

In these respects, the Fire Sound Simulator according to the present invention substantially departs from the conventional concepts and designs of the prior art, and in so doing provides an apparatus primarily developed for the purpose of simulating the hissing, popping and crackling sound of a fire.

Still yet another object of the present invention is to provide a new Fire Sound Simulator for use with a natural gas fireplace.

Even still another object of the present invention is to provide a new Fire Sound Simulator mountable within common natural gas fireplace accessories such as decorative logs, mantles and log baskets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of a stand-alone housing for containing the new Fire Sound Simulator.

FIG. 3 is an perspective view of a log basket including decorative logs for containing the new Fire Sound Simulator.

DESCRIPTION OF THE PREFERRED EMBODIMENT

Figure 1:
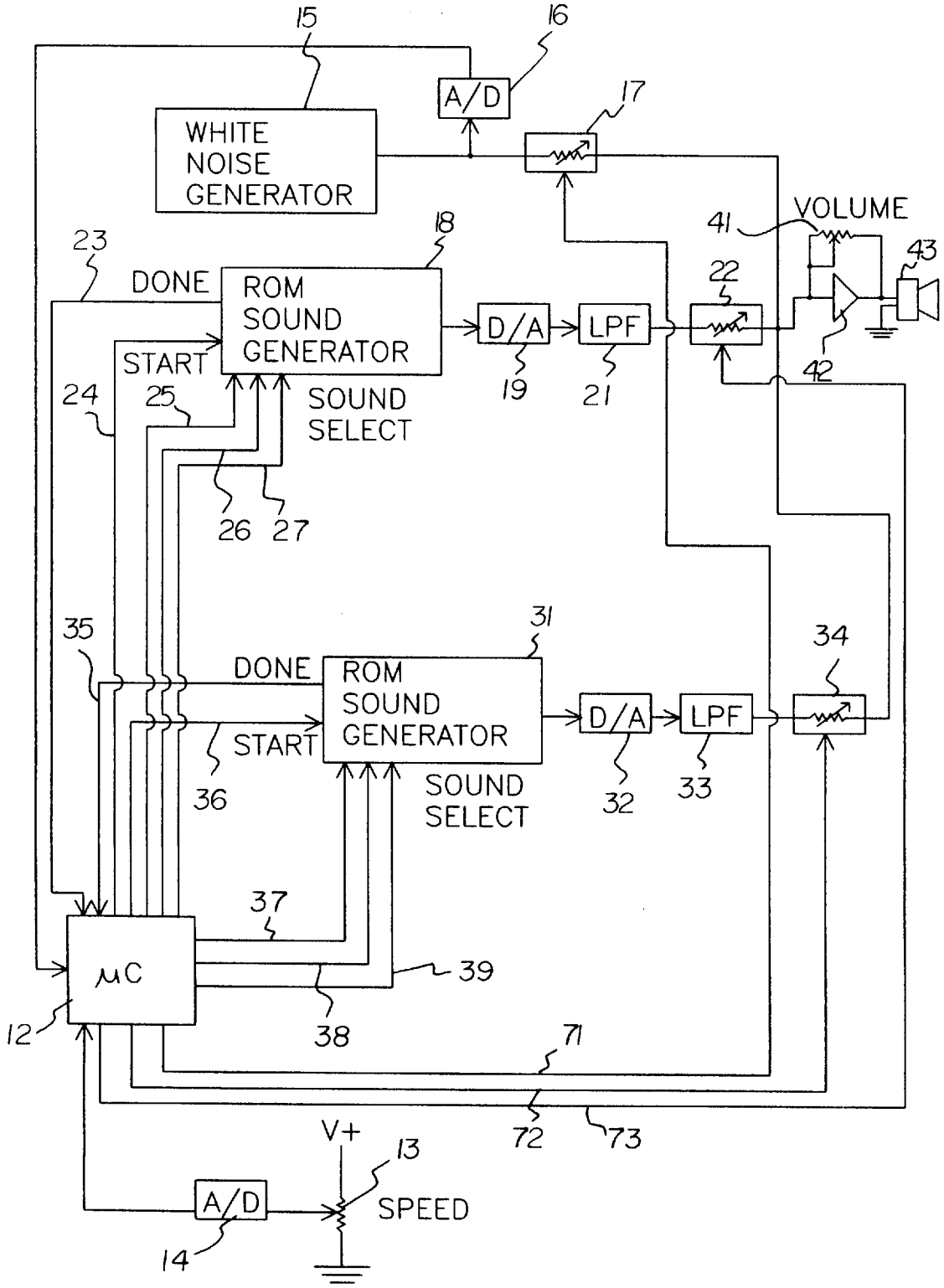
FIG. 1 is a schematic view of a new Fire Sound Simulator according to the present invention.

With reference now to the drawings, and in particular to FIGS. 1 through 3 thereof, a new Fire Sound Simulator embodying the principles and concepts of the present invention and generally designated by the reference numeral 10 will be described.

More specifically, it will be noted that the Fire Sound Simulator 10 comprises a white noise generator 15 for generating a white noise signal representative of a hissing sound, a means for generating a popping sound representative of a popping sound including a first ROM-based sound generator 18 coupled to a first low pass filter 21 through a first digital to analog converter 19, a means for generating a crackling sound representative of a crackling sound including a second ROM-based sound generator 31 coupled to a second low pass filter 33 through a second digital to analog converter 32, a microcontroller 12 operably coupled to the first ROM-based sound generator 18 and to the second ROM-based sound generator 31, a mixing means for mixing the white noise signal, the popping signal and the crackling signal including a first digital potentiometer 17 connected to receive the white noise signal, a second digital potentiometer 22 connected to receive the popping signal, and a third digital potentiometer 34 connected to receive the crackling signal, the mixing means operably coupled to the microcontroller 12, an audio amplifier 42 for amplifying the amplifier input signal and for generating an amplifier output signal, and a sound speaker 43 connected to receive the amplifier output signal. All of the above-described components are powered by a dc power source.

With reference to FIG. 1 there is shown the microcontroller 12 operably coupled to the first ROM-based sound generator 18 and to the second ROM-based sound generator 31. The first and second ROM-based sound generators 18 and 31 include a first and second counting means respectively, each counting means including a clocked counter. Each ROM-based sound generator includes 8 bit words addressable by conventional means. One of the bits of each 8 bit word is used as a flag or done bit, the purpose of which is described hereinafter. The remaining 7 bits represent digitized samples of popping sounds, in the case of the first ROM-based sound generator 18, and crackling sounds, in the case of the second ROM-based sound generator 31.

Sound select lines 25–27 are shown coupled to the first ROM-based sound generator 18 for selecting from among eight distinct finite sets of 8 bit words representing popping sounds. Sound select lines 37–39 are shown coupled to the second ROM-based sound generator 31 for selecting from among eight distinct finite sets of 8 bit words representing crackling sounds. In this manner, subtly different popping and crackling sounds can be generated.

With continued reference to FIG. 1 there is shown a first low pass filter 21 coupled to the first ROM-based sound generator through a first digital to analog converter 19. The first low pass filter 21 filters the high frequency components of the first digital to analog converter's 19 output. In similar fashion, a second low pass filter 33 filter's the high frequency components of a second digital converter's 32 output. The second digital to analog converter 32 is shown coupled between the second ROM-based sound generator 31 and the second low pass filter 33.

A mixing means is provided including a first digital potentiometer 17 connected to the white noise generator 15 to receive the white noise signal, a second digital potentiometer 22 connected to the first low pass filter 21 to receive the popping signal and a third digital potentiometer 34 connected to the second low pass filter 33 to receive the crackling signal. The output of the first, second and third digital potentiometers 17, 22 and 34 provides an amplifier input signal to the audio amplifier 42 which generates an amplifier output signal and has a volume control including a volume potentiometer 41. The sound speaker 43 is shown connected to receive the amplifier output signal. The microcontroller 12 includes firmware for randomly setting the first, second and third digital potentiometers 17, 22 and 34 in order to vary the mix and intensity of the amplifier input signal.

Microcontroller 12 includes firmware for randomly selecting from among the eight distinct finite sets of 8 bit words representing popping sounds and from among the eight distinct finite sets of 8 bit words representing crackling sounds. The source of randomness is shown including a third analog to digital converter 16 coupled to the white noise generator 15. The third analog to digital converter 16 samples the white noise signal at a rate of ten samples per second and generates a random value for use by the microcontroller 12. Once the microcontroller 12 selects the distinct finite set of 8 bit words, a first and second start signal is output to the first and second ROM-based sound generators 18 and 31 on lines 24 and 36 and each distinct finite set of 8 bit words is output to the first and second digital to analog converters 19 and 32 until the flag or done bit is encountered. This event is signaled to the microcontroller 12 by means of lines 23 and 35.

The microcontroller 12 also includes firmware which provides a means for controlling the frequency of generation of the first and second start signals. A user-selected value is selected by means of a potentiometer 13 coupled to a fourth analog to digital converter 14 which in turn is coupled to the microcontroller 12. The first and second start signals are generated in the event the random value exceeds the user-selected value.

With reference to FIG. 2 there is shown a housing 51 for containing the above-described circuitry. An aperture 53 is shown formed on a top portion 58 of the housing for accommodating a sound speaker grill 53 shown disposed therein. An on/off switch 54 is shown for powering the circuit of the invention. An optional volume control 55 is shown as well as a fire size control 56 which is used to set the potentiometer 13. An wall mounted ac/dc converter 59 is shown as a dc power source.

With reference to FIG. 3, an alternative embodiment 60 of the present invention is shown wherein the circuitry is enclosed within a base 64 having a decorative log basket 63 fixedly attached thereupon. The decorative log basket 63 includes a handle 61 welded thereto and is shown with decorative logs 62 disposed therein. An on/off switch 66 is shown as well as an aperture 69 for accommodating a sound speaker grill 69 which is shown disposed therein. An optional volume control 67 and fire speed control 68 are also shown.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Fire Sound Simulator powered by a direct current power source comprising:

a white noise generator for generating a white noise signal representative of a hissing sound;

a means for generating a popping signal representative of a popping sound;

a means for generating a crackling signal representative of a crackling sound;

a microcontroller operably coupled to the means for generating the popping signal and the means for generating the crackling signal, the microcontroller generating a first start signal for activating the means for generating the popping signal and a second start signal for activating the means for generating the crackling signal;

a mixing means for mixing the white noise signal, the popping signal and the crackling signal, and for generating an amplifier input signal, the mixing means being operably coupled to the microcontroller;

an audio amplifier for amplifying the amplifier input signal and for generating an amplifier output signal; and a sound speaker connected to receive the amplifier output signal.

2. The Fire Sound Simulator of claim 1, wherein the means for generating a popping signal representative of a popping sound further comprise a first ROM-based sound generator coupled to a first low pass filter through a first digital to analog converter.

3. The Fire Sound Simulator of claim 2, wherein the first ROM-based sound generator further comprises a first counting means for counting through a finite set of 8 bit words, one of the bits being a done bit, the done bit for signaling the last 8 bit word in the finite set, the remaining bits being representative of a plurality of sampled popping sounds, and wherein the microcontroller further comprises means for selecting the finite set of 8 bit words from among a plurality of finite sets of 8 bit words.

4. The Fire Sound Simulator of claim 3, wherein the means for generating a crackling signal representative of a crackling sound further comprise a second ROM-based sound generator coupled to second low pass filter through a second digital to analog converter.

5. The Fire Sound Simulator of claim 4, wherein the second ROM-based sound generator further comprises a second counting means for counting through a finite set of 8 bit words, one of the bits being a done bit, the done bit for signaling the last 8 bit word in the finite set, the remaining bits being representative of a plurality of sampled crackling sounds, and wherein the microcontroller further comprises means for selecting the finite set of 8 bit words from among a plurality of finite sets of 8 bit words.

6. The Fire Sound Simulator of claim 1 further comprising a means for controlling the frequency of generation of the first and second start signals.

7. The Fire Sound Simulator of claim 6, wherein the means for controlling the frequency of generation of the first and second start signals further comprise a third analog to digital converter coupled to the white noise generator, the third analog to digital converter for sampling the white noise signal at a rate of ten samples per second and generating a random value, and further comprising a fourth analog to digital converter coupled to a potentiometer for generating a user-selected value, the microcontroller comprising means for comparing the random value to the user-selected value and generating the first and second start signals provided the random value exceeds the user-selected value.

8. The Fire Sound Simulator of claim 1, wherein the mixing means further comprise a first digital potentiometer connected to receive the white noise signal, a second digital potentiometer connected to receive the popping signal, a third digital potentiometer connected to receive the crackling signal, the first, second and third digital potentiometers being operably coupled to the microcontroller, the microcontroller further comprising means for randomly setting the first, second and third digital potentiometers.

9. A Fire Sound Simulator powered by a direct current power source comprising:

a housing having disposed therein, a white noise generator for generating a white noise signal representative of a hissing sound;

a means for generating a popping signal representative of a popping sound;

a means for generating a crackling signal representative of a crackling sound;

a microcontroller operably coupled to the means for generating the popping signal and the means for generating the crackling signal, the microcontroller generating a first start signal for activating the means for generating the popping signal and a second start signal for activating the means for generating the crackling signal;

a mixing means for mixing the white noise signal, the popping signal and the crackling signal, and for generating an amplifier input signal, the mixing means being operably coupled to the microcontroller;

an audio amplifier for amplifying the amplifier input signal and for generating an amplifier output signal; and a sound speaker connected to receive the amplifier output signal.

* * * * *